US006641455B2

(12) United States Patent
Chan

(10) Patent No.: US 6,641,455 B2
(45) Date of Patent: Nov. 4, 2003

(54) INTERACTIVE TOY PLAY SET

(76) Inventor: Albert Wai Tai Chan, 8F, No. 107, Zhou-Z Street, (B. Technology Building) Nelhu, Taipei 114 (TW)

( * ) Notice: Subject to any disclaimer, the term of this patent is extended or adjusted under 35 U.S.C. 154(b) by 0 days.

(21) Appl. No.: 10/230,241

(22) Filed: Aug. 29, 2002

(65) Prior Publication Data

US 2003/0045204 A1 Mar. 6, 2003

Related U.S. Application Data

(60) Provisional application No. 60/316,016, filed on Aug. 31, 2001.

(51) Int. Cl.[7] ..... A63H 5/00
(52) U.S. Cl. ..... 446/297; 446/397
(58) Field of Search ..... 446/85, 86, 91, 446/144, 175, 297, 397, 472, 477, 484

(56) References Cited

U.S. PATENT DOCUMENTS 6,135,845 A * 10/2000 Klimpert et al. ..... 446/297
6,171,168 B1 * 1/2001 Jessop ..... 446/297
6,514,078 B1 * 2/2003 Jones ..... 434/81

* cited by examiner

*Primary Examiner*—Jacob K. Ackun
(74) *Attorney, Agent, or Firm*—Kramer & Amado, P.C.; Gordon J. Zimmerman

(57) ABSTRACT

A toy play set comprises a body portion comprising sound reproduction means, an integrated circuit comprising pre-programmed data adapted to be converted to audible sounds by the sound reproduction means, a source of electrical power to power said integrated circuit and said sound reproduction means, a holder comprising sensor means, the sensor means adapted for electromagnetic communication with the integrated circuit; and a play item comprising a play item electrical circuit, contact means adapted for electromagnetic communication with the electrical circuit, contact means further adapted for electromagnetic communication with the sensor means, the holder adapted to releasably receive the play item; such that when the play item is placed in the holder, the contact means electromagnetically contacts the sensor means to generate a play item signal unique to the electrical circuit of the play item, and the integrated circuit generates a placement comment from the pre-programmed data, which comment is appropriate to the placement, and the comment is audibly reproduced by the sound reproduction means.

31 Claims, 5 Drawing Sheets

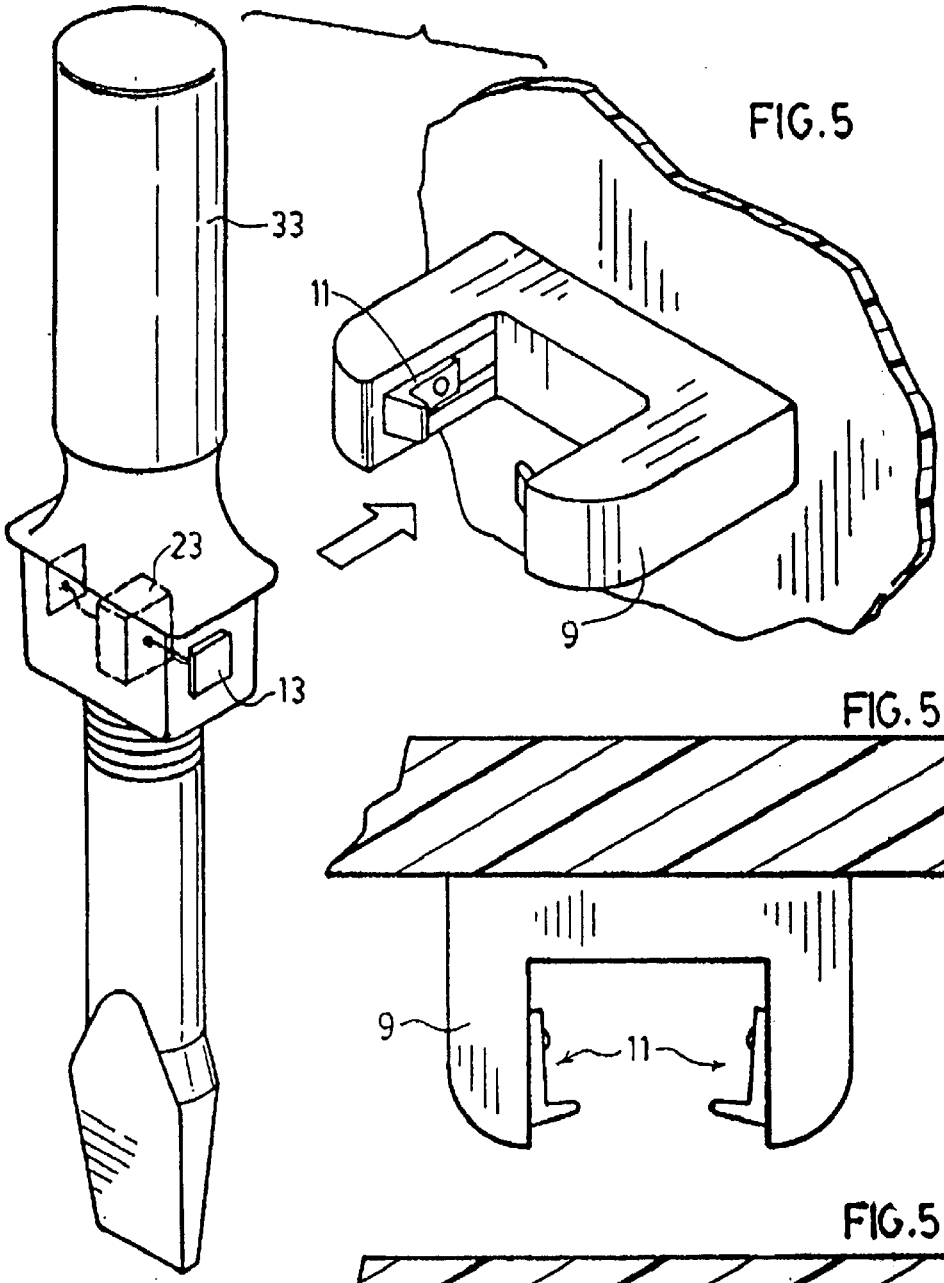
FIG.5
FIG.5A
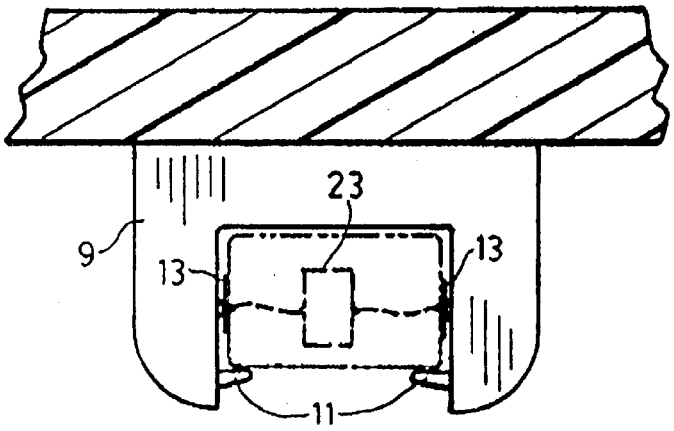
FIG.5B

INTERACTIVE TOY PLAY SET

This application claims the benefit of U.S. Provisional Application No. 60/316,016 entitled "Interactive Toy Play Set," filed on Aug. 31, 2001.

BACKGROUND TO THE INVENTION

Toy play sets have been of interest to children for many years. Typically, such play sets are passive and the child who plays with them is left completely to his or her imagination in terms of the placement of items in the play set and play scenarios appropriate to the play set. Accordingly, it would be an advantage to have a play set which is interactive with the child, in order to increase interest, to provide play scenarios, or to provide educational information or play structure.

SUMMARY OF THE INVENTION

In accordance with a principal aspect of the invention, a toy play set comprises: a body portion comprising: sound reproduction means; processing means comprising an integrated circuit comprising pre-programmed data adapted to be converted to audible sounds by said sound reproduction means; a source of electrical power to power said integrated circuit and said sound reproduction means; a holder comprising sensor means; said sensor means adapted for electromagnetic communication with said integrated circuit; and a play item comprising: a play item electrical circuit; contact means adapted for electromagnetic communication with said electrical circuit; said contact means further adapted for electromagnetic communication with said sensor means; said holder adapted to releasably receive said play item; such that when said play item is placed in said holder, said contact means electromagnetically contacts said sensor means to generate a play item signal unique to said electrical circuit of said play item, and said integrated circuit generates a placement comment from said pre-programmed data which comment is appropriate to said placement, and said comment is audibly reproduced by said sound reproduction means.

In further aspects of the invention:

(a) when the play item is removed from the holder, the integrated circuit generates a removal comment appropriate to the removal, and the comment is audibly reproduced by the sound reproduction means;

(b) the play set further comprises multiple holders and multiple play items, and each holder corresponds to one of the multiple play items;

(c) when a play item is placed in a holder to which it does not correspond, the placement comment generated and audibly reproduced indicates that an improper placement has occurred;

(d) the toy play set comprises one of a tool bench, a laboratory, a kitchen, a vanity, a bathroom, a bedroom, a travel case, a hairdressing salon, or a recording studio;

(e) the integrated circuit is programmed to generate signals for audible reproduction to prompt the removal of play items from their corresponding holders in a specific order to correspond with a particular play activity.

In a particular aspect of the invention, a toy work bench play set comprises: a bench and tool rack comprising: sound reproduction means; processing means comprising an integrated circuit comprising pre-programmed data adapted to be converted to audible sounds by the sound reproduction means; a source of electrical power to power the integrated circuit and the sound reproduction means; a holder comprising sensor means; the sensor means adapted for electromagnetic communication with the integrated circuit; and a play item comprising: a play item electrical circuit; contact means adapted for electromagnetic communication with the electrical circuit; the contact means further adapted for electromagnetic communication with the sensor means; the holder adapted to releasably receive the play item; such that when the play item is placed in the holder, the contact means electromagnetically contacts the sensor means to generate a play item signal unique to the electrical circuit of the play item and the integrated circuit generates a placement comment from the pre-programmed data which comment is appropriate to the placement, and the comment is audibly reproduced by the sound reproduction means.

In further aspects of the toy work bench play set of the invention:

(a) when the play item is removed from the holder, the integrated circuit generates a removal comment appropriate to the removal, and the comment is audibly reproduced by the sound reproduction means;

(b) the toy work bench play set further comprises multiple holders and multiple play items, wherein each holder corresponds to one of the multiple play items;

(c) when a play item is placed in a holder to which it does not correspond, the placement comment generated and audibly reproduced indicates that an improper placement has occurred;

(d) the sound reproduction means comprises an audio speaker;

(e) the sensor means and the contact means comprise metal electrical contacts;

(f) the contact means comprises an electromagnetic radiation emitting element adapted to emit a play item signal corresponding to the particular play item electrical circuit of the play item with which the contact means is associated, and wherein the sensor means comprises an electromagnetic radiation sensor adapted to detect the play item signal;

(g) the source of electrical power comprises an electrical storage battery;

(h) the play item is selected from the category of screwdrivers, hammers, pliers, wrenches, drills, saws and safety eyewear;

(i) one of the play items comprises toy safety eyewear, and the safety eyewear must be removed from its corresponding holder before the integrated circuit will generate a comment authorizing use of other play items;

(j) the play set further comprises a toy table saw, wherein the integrated circuit is adapted to generate a signal corresponding to the sound of a table saw;

(k) one of the play items comprises toy safety eyewear, and the safety eyewear must be removed from its corresponding holder before the integrated circuit will generate the signal corresponding to the sound of a table saw;

(l) the play set further comprises a certain play item sized differently from other play items, and a corresponding certain holder sized so as not to receive snugly other play items, and the certain holder comprises a mechanical switch adapted to be triggered only when the certain play item is placed snugly therein;

(m) the certain play item comprises a toy telephone.

Further aspects of the invention will be apparent from the following description and drawings.

BRIEF DESCRIPTION OF THE DRAWINGS

FIGS. 4 and 5, 5A and 5B illustrate the components of play items, or tools, and holders.

DETAILED DESCRIPTION OF THE INVENTION

The toy play set invention described herein is applicable to any appropriate toy play set. Such play sets may include a tool bench, a laboratory, a kitchen, a vanity, a bathroom, a bedroom, a travel case, a hairdressing salon, a concert stage, a recording studio, or any other appropriate play set environment.

For example, in a laboratory play set, the play items could include test tubes, beakers, burners, cleaning brushes, chemical containers, safety glasses, and the like. In a kitchen play set, the play items could include pots, pans, dishes, cups, cutlery, bowls, colanders, spray washing heads, various utensils, and the like. In a vanity play set, the play items could include a curling iron, a blow dryer, make-up containers and the like. For a concert stage play set, the play items could include a microphone, an amplifier, musical instruments, and the like. Any suitable combination of play set and play items may be employed.

Figure 1:
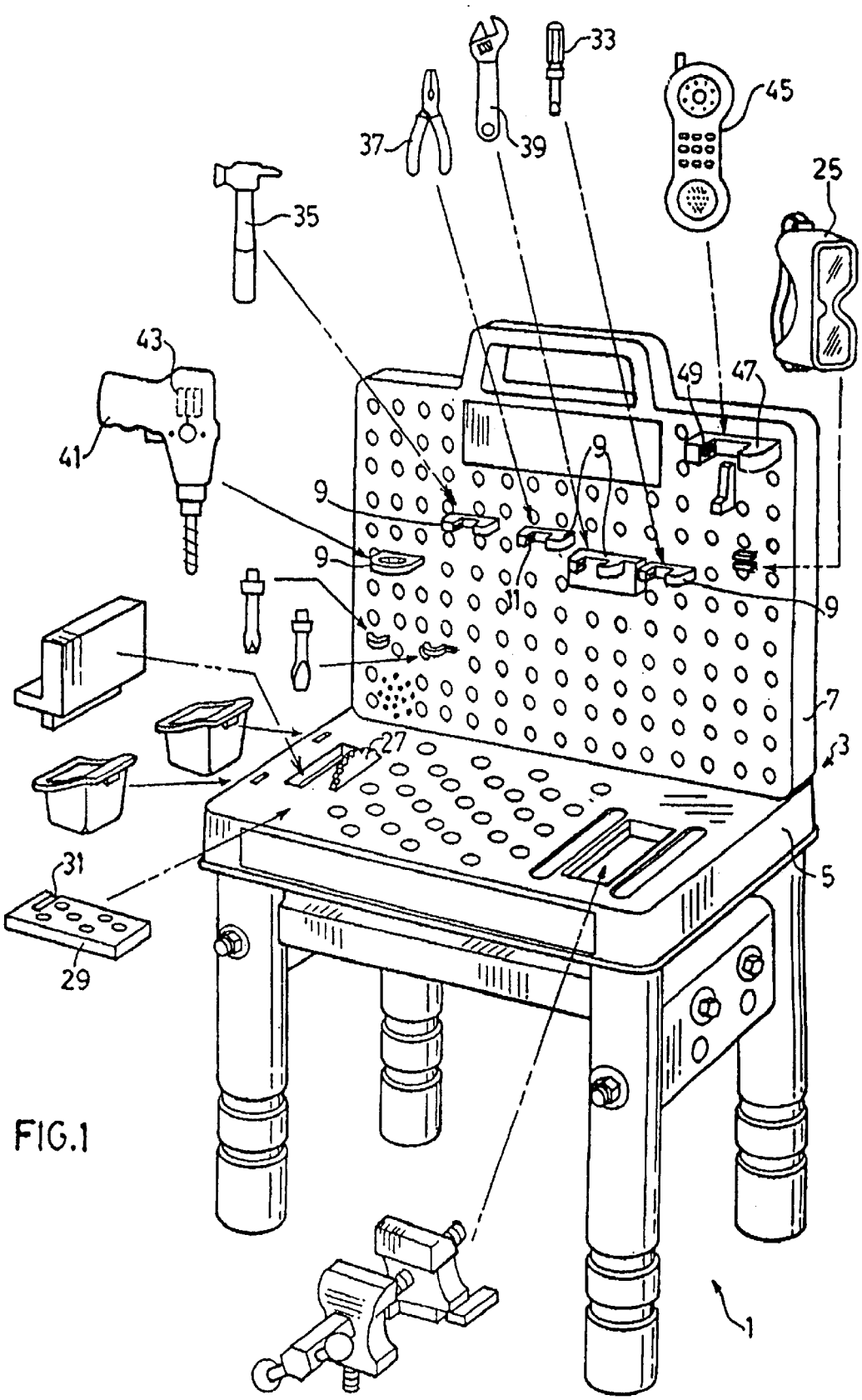
FIG. 1 is an exploded, front, perspective representation of a tool bench play set.
Figure 2:
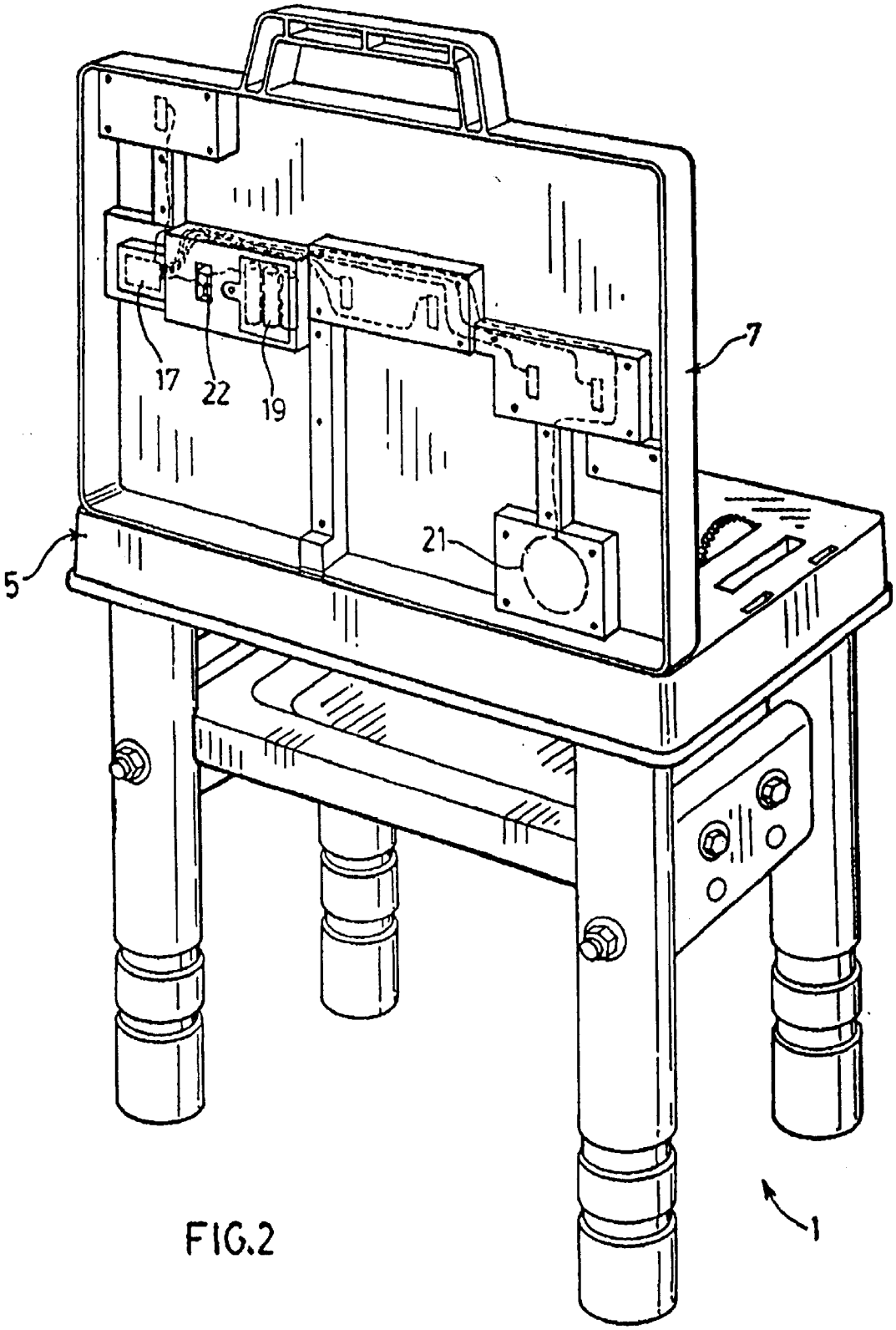
FIG. 2 is a rear, perspective view of a play set without play items.
Figure 3:
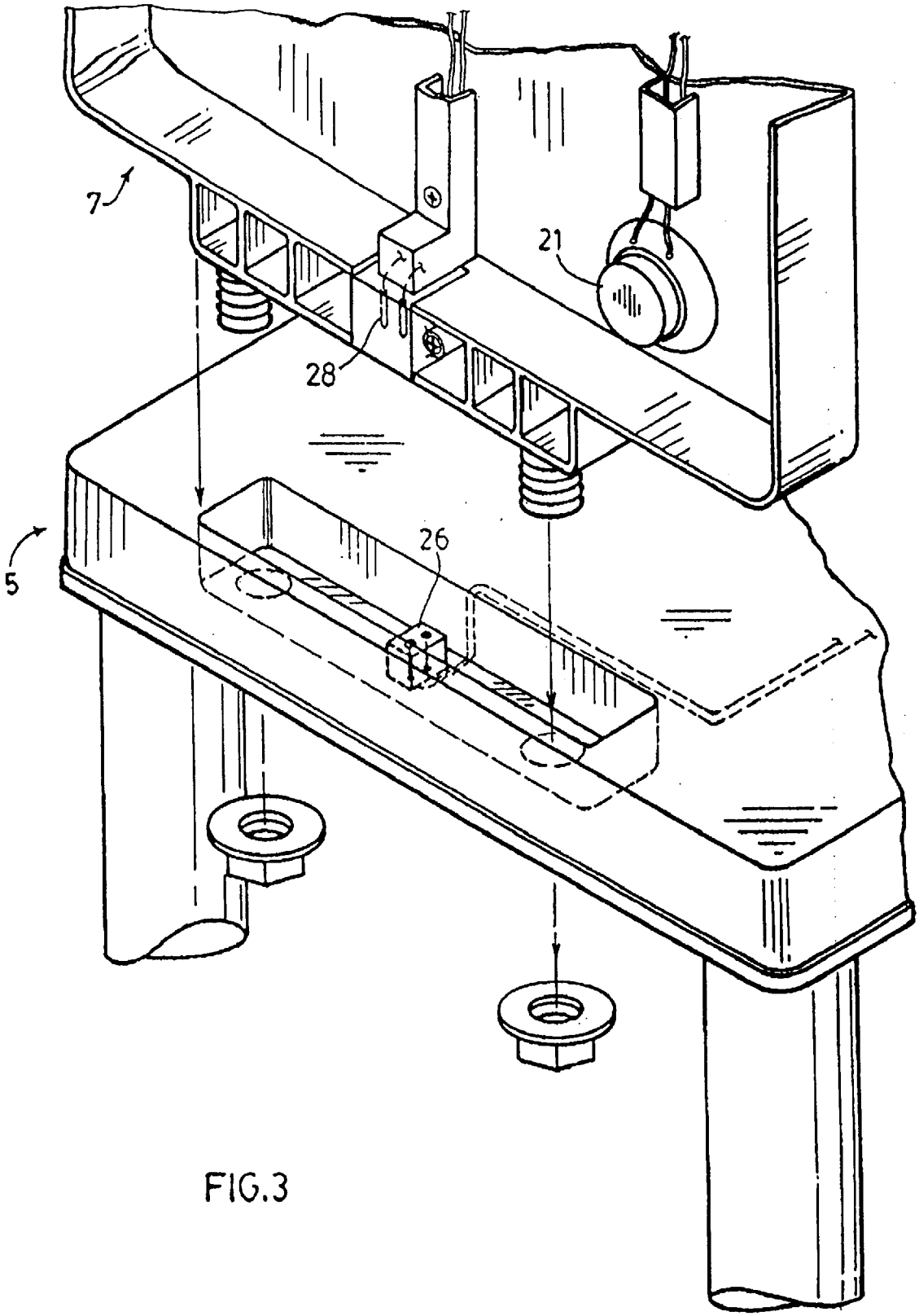
FIG. 3 is a cut-away, perspective view of the construction of a play set with electrical connections.

An illustrative embodiment of the invention is a toy work bench play set (1) as illustrated in FIGS. 1 to 3. The body portion (3) of the tool bench play set (1) comprises a work bench (5) and a tool rack (7). The tool rack (7) comprises a number of holders (9) sized to fit particular play items (25, 33, 35, 37, 39, 41), in this case tools and accessories. Each holder comprises one or more sensors (11) adapted to correspond with an equivalent number of contact means (13) on the corresponding tools adapted to be placed in each holder (9). In the illustrative embodiment shown in the drawings, the sensor means (11) comprise electrical contacts. These contacts are either electrically or electromagnetically connected to one or more processing means comprising integrated circuits (17). The integrated circuits are pre-programmed with certain data. The data will normally comprise recorded sounds consisting of speech and sound effects.

Figure 4:
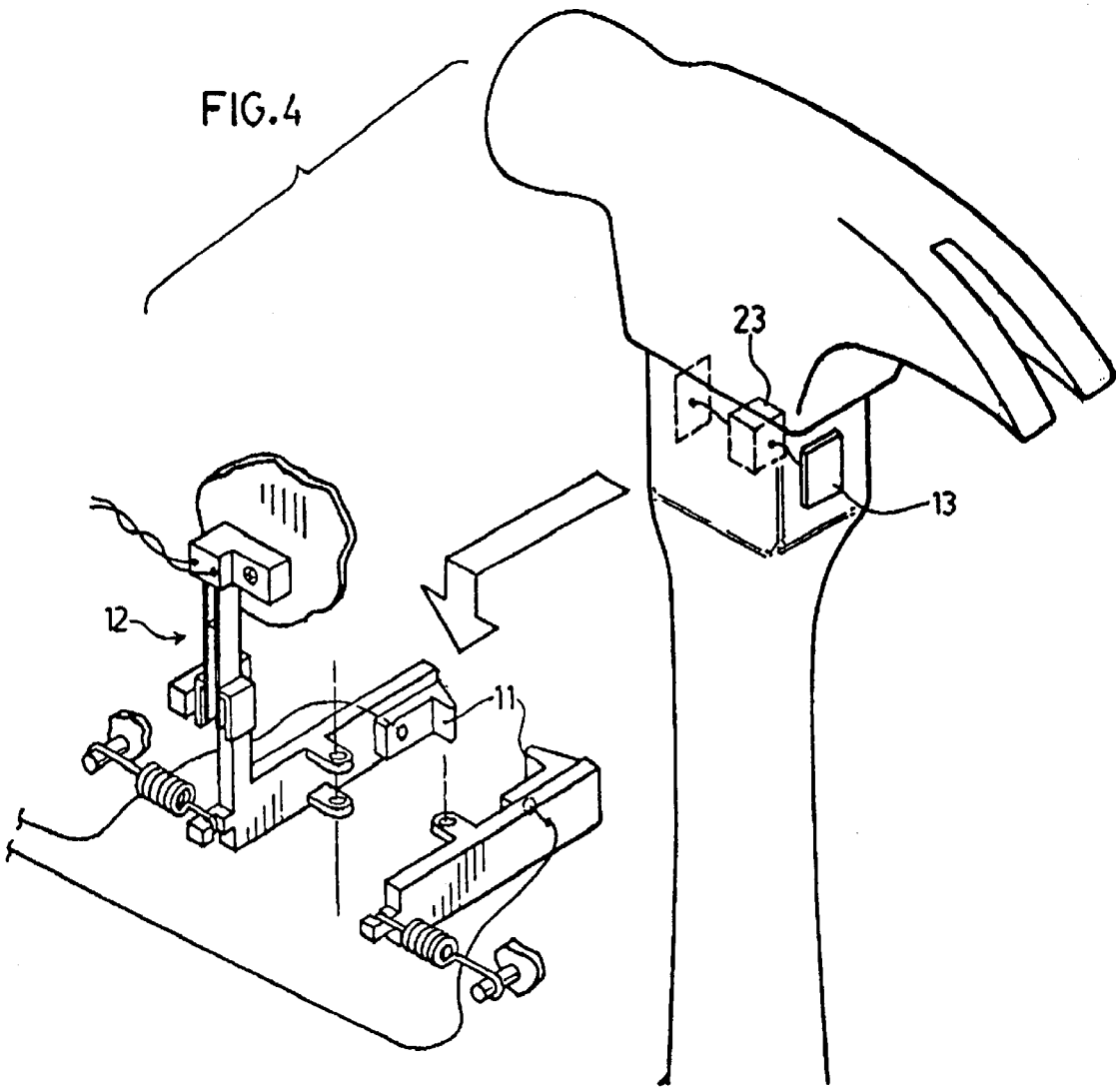

The play items in this work bench play set comprise various tools and accessories which may be placed in specific designated holders. As best illustrated in FIGS. 4 and 5, each tool comprises the contact means (13) adapted to come into contact, or near contact, with the sensor means (11) in each holder (9). Each sensor is electrically or electromagnetically connected to the processor means, comprising an integrated circuit, in a manner known in the art. As illustrated in FIG. 4, placement of a tool in the holder may trigger a switch (12) to indicate that some tool, even if not the designated tool, has been placed in the holder. There is a source of electrical power (19), in this case electrical storage batteries, in the body portion of the play set, as shown in FIG. 2, designed to provide power to the integrated circuit and to the sound reproduction means (21). In the work bench play set illustrated, the sound reproduction means comprises one or more audio speakers, and any associated electronics, as is known in the art. Data from the integrated circuit (17) is transported to the sound reproduction means (21) through well-known sound reproduction elements in order to produce sounds at an audio speaker. A mechanical switch (22) is used to place the play set into "Off", "Play" or "Try Me" modes, as is known in the art.

If desired, as shown in FIG. 1, any individual play item (41) may be provided with its own source of battery power (43) to produce sound effects through its own integrated circuit and sound reproduction means, or mechanical means, when in operation, as known in the art.

Although the embodiment illustrated uses electrical contacts both as contact means and sensor, the contact means could comprise a source of electromagnetic energy, such as an infrared emitter, while the sensor could comprise a detector of such electromagnetic energy.

Each play item comprises a unique electrical circuit (23), as illustrated in FIGS. 4, 5 and 5B. Each holder is designed to accept a number of tools, but to be dedicated to only one tool. When a play item (33, 35) is placed into a holder (9), and electrical or electromagnetic contact is made between the contact means (13) and the sensor means (11), a completed circuit is created. Given the individual characteristics of each unique electrical circuit (23), the integrated circuit (17) in the body (3) is able to recognize whether or not the correct play item has been placed in the holder. The integrated circuit (17) is then triggered to generate an audible comment in accordance with the placement. The comment may indicate that: the play item, or tool, was properly placed; or that it was improperly placed, and that another tool should be substituted; or that the tool should be placed in its correct holder. When a play item is removed from its correct holder (9), the integrated circuit (17) recognizes that the status of the play item in the holder has changed, and a further appropriate comment can be generated. For example, if the screwdriver (33) is removed from its holder, the comment generated could indicate that now it is time to play with the screwdriver. If the screwdriver is placed in an incorrect holder, the comment would indicate that fact and invite the user to place the screwdriver in the correct holder.

In order to teach safety measures to the child using the toy, one of the play items in the preferred embodiment of the tool bench is a pair of safety goggles or safety glasses (25). When the safety goggles are removed from their designated holder, and the status of the completed circuit is thus changed, the integrated circuit (17) is prompted to generate a comment inviting the user to wear the safety goggles and to go on to use other tools. By contrast, if a tool is removed before the safety goggles or glasses are removed from their designated holder, a comment is generated indicating that the glasses or goggles should be worn before any tool is used.

An electrical connection may be provided between the work bench (5) and the tool rack (7). As illustrated in FIG. 3, electrical connectors (26, 28) located on the work bench (5) and the tool rack (7) respectively serve to conduct electrical power and electrical signals between these major components of the assembled work bench play set (1).

Particular variations on this safety theme can be incorporated into the tool bench (5). For example, as illustrated in FIG. 1, a simulated saw blade (27) is provided in the preferred embodiment. Although the saw blade (27) is not rotated, when pressure is placed on it, such as by use of a simulated piece of wood (29) with a spring loaded section (31) adapted to retract when pressed against the saw blade to simulate the sawing action, the integrated circuit (17) will generate a signal to simulate the sounds of a saw when reproduced by the sound reproduction means. However, if the safety goggles or glasses (25) have not been previously removed from their holder, the saw (27) will appear not to function, and a comment will be generated indicating that the user must employ the safety goggles or glasses prior to using the saw. Thus, the processing means comprising the integrated circuit may be programmed to require that the tools or accessories be used in a particular order to generate desired appropriate results or comments.

In the work bench play set disclosed, the appropriate play items include a screwdriver (33), a hammer (35), a pair of pliers (37), a wrench (39), an electric drill (41), and safety eyewear (25). Other tools such as hand saws, files, T-squares, and the like (not shown) could obviously also be employed.

In the work bench illustrated in FIG. 1, the electric drill (41) is provided with its own source of battery power (43) and associated electronic or mechanical sound generation means as known in the art, in order to generate the sounds of a drill when placed in operation.

In the embodiment illustrated in FIG. 1, a toy telephone (45) is also included as a play item. The telephone holder (47) is connected electrically or electromagnetically to an integrated circuit (17). The telephone (45) illustrated, however, does not comprise contact means. The telephone holder(47) does comprise sensor means which, in this case, is a mechanical switch (49). When the telephone (45) is snugly placed in the holder (47), the mechanical switch (49) is actuated and an appropriate comment is generated by means of the integrated circuit (17) and sound reproduction means. An appropriate comment may also be generated when the telephone (45) is removed from its holder (47) and the mechanical switch (49) is released. This form of sensor activation, however, is less sophisticated than that of the combination of play items and sensors of the preferred embodiment, since any tool or other item, if placed snugly within the holder (47) to actuate the mechanical switch (49), will generate the same response as if the telephone had been so placed.

Further aspects of the invention will be apparent to those skilled in the art and the invention is not to be taken as restricted to the preferred embodiment illustrated.

What is claimed is:

1. A toy play set comprising:

(a) a body portion comprising:

(i) sound reproduction means;

(ii) processing means comprising an integrated circuit comprising pre-programmed data adapted to be converted to audible sounds by said sound reproduction means;

(iii) a source of electrical power to power said integrated circuit and said sound reproduction means;

(iv) a holder comprising sensor means;

(v) said sensor means adapted for electromagnetic communication with said integrated circuit;

(b) a play item comprising:

(i) a play item electrical circuit;

(ii) contact means adapted for electromagnetic communication with said electrical circuit;

(iii) said contact means further adapted for electromagnetic communication with said sensor means;

said holder adapted to releasably receive said play item;

such that when said play item is placed in said holder, said contact means electromagnetically contacts said sensor means to generate a play item signal unique to said electrical circuit of said play item, and said integrated circuit generates a placement comment from said pre-programmed data which comment is appropriate to said placement, and said comment is audibly reproduced by said sound reproduction means.

2. The toy play set of claim 1, wherein when said play item is removed from said holder, said integrated circuit generates a removal comment appropriate to said removal, and said comment is audibly reproduced by said sound reproduction means.

3. The toy play set of claim 1, further comprising multiple holders and multiple play items, wherein each holder corresponds to one of the multiple play items.

4. The toy play set of claim 2, further comprising multiple holders and multiple play items, wherein each holder corresponds to one of the multiple play items.

5. The toy play set of claim 3, wherein when a play item is placed in a holder to which it does not correspond, the placement comment generated and audibly reproduced indicates that an improper placement has occurred.

6. The toy play set of claim 4, wherein when a play item is placed in a holder to which it does not correspond, the placement comment generated and audibly reproduced indicates that an improper placement has occurred.

7. The toy play set of claim 1, where the toy play set comprises one of a tool bench, a laboratory, a kitchen, a vanity, a bathroom, a bedroom, a travel case, a hairdressing salon, a concert stage or a recording studio.

8. The toy play set of claim 2, where the toy play set comprises one of a tool bench, a laboratory, a kitchen, a vanity, a bathroom, a bedroom, a travel case, a hairdressing salon, a concert stage or a recording studio.

9. The toy play set of claim 3, where the toy play set comprises one of a tool bench, a laboratory, a kitchen, a vanity, a bathroom, a bedroom, a travel case, a hairdressing salon, a concert stage or a recording studio.

10. The toy play set of claim 4, where the toy play set comprises one of a tool bench, a laboratory, a kitchen, a vanity, a bathroom, a bedroom, a travel case, a hairdressing salon, a concert stage or a recording studio.

11. A toy work bench play set comprising:

(a) a bench and tool rack comprising:

(i) sound reproduction means;

(ii) processing means comprising an integrated circuit comprising pre-programmed data adapted to be converted to audible sounds by said sound reproduction means;

(iii) a source of electrical power to power said integrated circuit and said sound reproduction means;

(iv) a holder comprising sensor means;

(v) said sensor means adapted for electromagnetic communication with said integrated circuit;

(b) a play item comprising:

(i) a play item electrical circuit;

(ii) contact means adapted for electromagnetic communication with said electrical circuit;

(iii) said contact means further adapted for electromagnetic communication with said sensor means;

said holder adapted to releasably receive said play item;

such that when said play item is placed in said holder, said contact means electromagnetically contacts said sensor means to generate a play item signal unique to said electrical circuit of said play item, and said integrated circuit generates a placement comment from said pre-programmed data which comment is appropriate to said placement, and said comment is audibly reproduced by said sound reproduction means.

12. The toy play set of claim 8, wherein when said play item is removed from said holder, said integrated circuit generates a removal comment appropriate to said removal, and said comment is audibly reproduced by said sound reproduction means.

13. The toy play set of claim 8, further comprising multiple holders and multiple play items, wherein each holder corresponds to one of the multiple play items.

14. The toy play set of claim 9, further comprising multiple holders and multiple play items, wherein each holder corresponds to one of the multiple play items.

15. The toy play set of claim 9, wherein when a play item is placed in a holder to which it does not correspond, the placement comment generated and audibly reproduced indicates that an improper placement has occurred.

16. The toy play set of claim 10, wherein when a play item is placed in a holder to which it does not correspond, the placement comment generated and audibly reproduced indicates that an improper placement has occurred.

17. The toy play set of claim 8, wherein the sound reproduction means comprises an audio speaker.

18. The toy play set of claim 8, wherein the sensor means and the contact means comprise metal electrical contacts.

19. The toy play set of claim 8, wherein the contact means comprises an electromagnetic radiation emitting element adapted to emit a play item signal corresponding to the particular play item electrical circuit of the play item with which said contact means is associated, and wherein the sensor means comprises an electromagnetic radiation sensor adapted to detect said play item signal.

20. The toy play set of claim 8, wherein the source of electrical power comprises an electrical storage battery.

21. The toy play set of claim 8, wherein the play item is selected from the category of screwdrivers, hammers, pliers, wrenches, drills, saws and safety eyewear.

22. The toy play set of claim 8, wherein one of said play items comprises toy safety eyewear, and wherein said safety eyewear must be removed from its corresponding holder before the integrated circuit will generate a comment authorizing use of other play items.

23. The toy play set of claim 8, further comprising a toy table saw, wherein said integrated circuit is adapted to generate a signal corresponding to the sound of a table saw.

24. The toy play set of claim 20, wherein one of the play items comprises toy safety eyewear, and wherein said safety eyewear must be removed from its corresponding holder before the integrated circuit will generate the signal corresponding to the sound of a table saw.

25. The toy play set of claim 8, further comprising a certain play item sized differently from other play items, and a corresponding certain holder sized so as not to receive snugly other play items, said certain holder comprising a mechanical switch adapted to be triggered only when said certain play item is placed snugly therein.

26. The toy play set of claim 22, wherein the certain play item comprises a toy telephone.

27. The toy play set of claim 3, wherein the integrated circuit is programmed to generate signals for audible reproduction to prompt the removal of play items from their corresponding holders in a specific order to correspond with a particular play activity.

28. The toy play set of claim 4, wherein the integrated circuit is programmed to generate signals for audible reproduction to prompt the removal of play items from their corresponding holders in a specific order to correspond with a particular play activity.

29. The toy play set of claim 5, wherein the integrated circuit is programmed to generate signals for audible reproduction to prompt the removal of play items from their corresponding holders in a specific order to correspond with a particular play activity.

30. The toy play set of claim 6, wherein the integrated circuit is programmed to generate signals for audible reproduction to prompt the removal of play items from their corresponding holders in a specific order to correspond with a particular play activity.

31. The toy play set of claim 7, wherein the integrated circuit is programmed to generate signals for audible reproduction to prompt the removal of play items from their corresponding holders in a specific order to correspond with a particular play activity.

* * * * *